US006175098B1

(12) United States Patent
Kim et al.

(10) Patent No.: US 6,175,098 B1
(45) Date of Patent: Jan. 16, 2001

(54) PLANE HEATING ELEMENT WITHOUT ELECTROMAGNETIC WAVES AND A MANUFACTURING METHOD THEREOF

(75) Inventors: Seo-Kon Kim, Anyang; Kun-Ho Yang; Sung-Nam Ju, both of Pyungtaek; Cheol-Sang Kim, Cheonju; Young-Joung Yoo, Kyungsangnam-do; Jae-Soon Hwang, Pyungtaek, all of (KR)

(73) Assignee: Solco Biomedical Co., Ltd., Kyungki-Do (KR)

( * ) Notice: Under 35 U.S.C. 154(b), the term of this patent shall be extended for 0 days.

(21) Appl. No.: 09/420,728

(22) Filed: Oct. 20, 1999

(30) Foreign Application Priority Data

Oct. 31, 1998 (KR) ..... 98-46515

(51) Int. Cl.[7] ..... H05B 1/00
(52) U.S. Cl. ..... 219/217; 219/212; 219/548
(58) Field of Search ..... 219/211, 212, 219/217, 527, 528, 529, 544, 548, 549, 552; 338/203, 214, 302, 303, 321; 392/432, 435

(56) References Cited

U.S. PATENT DOCUMENTS 982,735 * 1/1911 McElroy ..... 338/303
1,074,216 * 9/1913 Schuirmann ..... 219/212
1,415,240 * 5/1922 Hynes ..... 338/303
2,527,026 * 10/1950 Mucher ..... 338/303
3,227,986 * 1/1966 Serdahely et al. ..... 338/303
3,634,655 * 1/1972 Jordan ..... 219/212
3,646,322 * 2/1972 Speekman ..... 219/549
3,739,142 * 6/1973 Johns ..... 219/212
4,577,094 * 3/1986 Mills ..... 219/212
4,665,302 * 5/1987 Bergersen ..... 219/212
4,742,212 * 5/1988 Ishii et al. ..... 219/549
4,788,417 * 11/1988 Graflind ..... 219/212
4,792,663 * 12/1988 Kishimoto et al. ..... 219/549
4,798,936 * 1/1989 Johnson, Sr. ..... 219/217
4,825,048 * 4/1989 Altmann et al. ..... 219/528
4,910,391 * 3/1990 Rowe ..... 219/549
5,521,358 * 5/1996 Eilentropp ..... 219/549
5,811,765 * 9/1998 Nakagawa et al. ..... 219/212

* cited by examiner

*Primary Examiner*—Teresa Walberg
*Assistant Examiner*—Fadi H. Dahbour
(74) *Attorney, Agent, or Firm*—Baker Botts L.L.P.

(57) ABSTRACT

A plane heating element is provided which features reduced external electromagnetic waves. The plane heating element includes an upper input terminal and a lower input terminal in which upper wires and lower wires are spaced apart at a predetermined interval, and the currents through the respective wires flow oppositely to each other. First heat generation wires are connected to the upper input terminal at predetermined spaced intervals and have the same directed current flow as that of the upper input terminal. Second heat generation wires are connected to the upper input terminal at spaced intervals and have the oppositely directed current flow to that of the first heat generation wires.

3 Claims, 3 Drawing Sheets

PLANE HEATING ELEMENT WITHOUT ELECTROMAGNETIC WAVES AND A MANUFACTURING METHOD THEREOF

CROSS REFERENCES TO RELATED APPLICATIONS

This application is based on application No. 98-46515 filed in the Korean Industrial Property Office on Oct. 31, 1998, the content of which is incorporated hereinto by reference.

BACKGROUND OF THE INVENTION (a) Field of the Invention

The present invention relates to a plane heating element and a manufacturing method thereof, particularly to the plane heating element that does not generate external electromagnetic waves and a manufacturing method thereof, wherein magnetic fields, formed by the currents that flow through both heat generation wires and input terminal, are eliminated and thus prevent the generation of electromagnetic waves harmful to the human body.

(b) Description of the Related Art

A plane heating element, such as a thermotherapeutic device or an electric blanket, generates heat in a predetermined area and is used for healing or providing warmth while contacting the human body.

Electricity is used as a power source whereby the plane heating element generates heat, and electricity forms a magnetic field and generates electromagnetic waves while a current flows. The formation of a magnetic field and the generation of electromagnetic waves vary in proportion with the magnitude of current. Because it is currently believed that electromagnetic waves cause a number of diseases and severe side effects, regulations on electromagnetic waves discharged from a variety of products are being enacted.

Therefore, although the plane heating element needs to resolve the EMF (Electromagnetic Field Frequency) issue, the conventional type of such element cannot easily achieve this.

A conventional heating element is structured such that the heat generation wires, having a resistance coefficient generated due to a zigzag patterned connection of the input wires, form a series circuit in view of a block entity, but form a parallel circuit within the block.

In this structure, the current flows in one particular direction through the input wires and heating lines. It also flows in one particular direction through the block entity as well as within the block.

As described above, the conventional heating element comprising input electric wires and heat generation wires has a drawback that these lines form magnetic fields when the current flows in a singular direction through both the input wires and the heat generation wires. This results in the generation of EMF harmful to the human body due to the associated magnetic field.

SUMMARY OF THE INVENTION

The present invention has been made in an effort to solve the above problems. Therefore, the purpose of the present invention is to provide a plane heating element that operates without generating external electromagnetic waves and a manufacturing method thereof in which the magnetic fields formed by the currents flowing through both heat generation lines and an input terminal are eliminated to thus get rid of electromagnetic frequencies harmful to the human body.

The present invention to achieve the above purpose comprising:

- an upper input terminal and a lower input terminal in which each upper wire and lower wire are spaced apart at a predetermined interval and the currents flow in opposite directions through these respective wires;
- first heat generation wires that are connected to the upper input terminal at predetermined spaced intervals and which have the same directed current flow as that of the upper input terminal; and
- second heat generation wires wherein the same are connected to the lower input terminal at spaced intervals and have the current flow oppositely directed to that of the first heat generation wires.

Accordingly, the upper input terminal and lower input terminal of the heating element receive the oppositely directed currents to each other.

The current that is input through the upper input terminal generates heat when flowing through the first heat generation wires, and the current that is input through the lower input terminal generates heat when flowing through the second heat generation wires.

Since the currents that are input through the upper input terminal and lower input terminal flow opposite to each other, the electromagnetic waves generated by the currents of the two input terminals are offset each other.

In addition, since the currents that are input through the first heat generation wires and the second heat generation wires flow oppositely to each other, the electromagnetic waves generated by the currents of each pair of these heat generation wires are offset each other.

BRIEF DESCRIPTION OF THE DRAWINGS

Further objects and other advantages of the present invention will become apparent from the following description in conjunction with the attached drawings, in which.

DETAILED DESCRIPTION OF THE PREFERRED EMBODIMENTS

Figure 1:
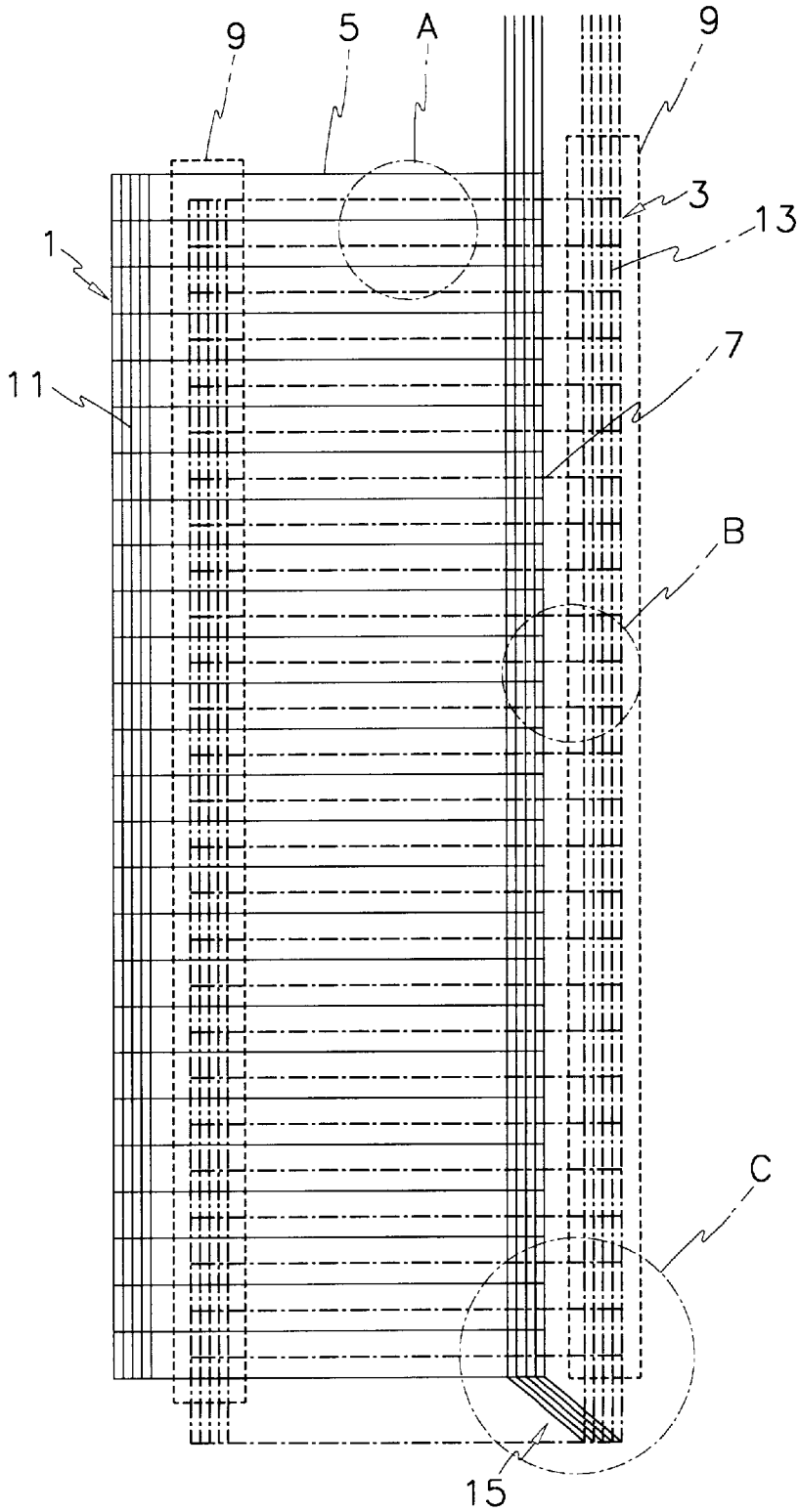
FIG. 1 is a wiring drawing showing the structure of a heat generation surface product according to the present invention with electromagnetic waves eliminated.

Preferred embodiment of the present invention will now be described in detail with reference to the accompanying drawings.

A plane heating element, with reference to FIG. 1, FIG. 2, FIG. 3, and FIG. 4, in which electromagnetic waves are eliminated comprising:

- an upper input terminal 1 and a lower input terminal 3 formed at a predetermined spaced interval with each other, and having the oppositely directed input currents with respect to the two terminals;
- first heat generation wires 5 connected to said upper input terminal 1 at a predetermined spaced intervals and having the same directed current flow as that of the upper input terminal;

second heat generation wires 7 connected to the lower input terminal 3 at a predetermined spaced intervals and having oppositely directed current flow to that of the first heat generation wires 5; and insulation bodies 9 that separate the upper input terminal 1 from the lower input terminal 3 and also insulate them.

The first heat generation wires 5 and the second heat generation wires 7 are preferably structured such that they are disposed at a spaced interval of 2 to 20 mm on the same plane.

The above upper input terminal 1 and the lower input terminal 3 include a plurality of the upper input wires 11 and lower input wires 13 that are disposed at a spaced interval on each upper and lower face of the insulation bodies 9.

The upper input wires 11 and lower input wires 13 can be disposed oppositely to each other at a predetermined spaced interval in order to effectively offset electromagnetic waves generated by the oppositely flowing currents from the insulation bodies 9.

The upper input wires 11 and the first heat generation wires 5, and the lower input wires 13 and the second heat generation wires 7 are respectively connected through a junction 15 between the upper input terminal and lower input terminal 3.

The present plane heating element in which electromagnetic waves are eliminated is designed according to the following steps:

disposing the insulation bodies 9 parallel to each other at a predetermined spaced interval;

disposing the upper input terminal 1 and the lower input terminal 3 respectively on opposite sides of the insulation bodies 9.

forming a first heat generation wires 5 and a second heat generation wires 7 respectively on the same plane at spaced intervals by alternately winding each input wire in the upper portion of the upper input terminal 1 and in the lower portion of the lower input terminal 3; and severing each portion of both the first heat generation wires 5 and the second heat generation wires 7 extending out from the upper input terminal 1 and the lower input terminal 3, while the first heat generation wires are connected to the upper input terminal, the second heat generation wires being connected to the lower input terminal.

The upper input terminal 1 and lower input terminal 3 of the surface heat generation device according to the above description are input with the currents flowing oppositely to each other.

The currents that are input into the upper input wires 11 of the upper input terminal 1 generate heat when flowing along the first heat generation wires 5, and the currents that are input into the lower input wires 13 of the lower input terminal 3 generate heat when flowing along the second heat generation wires 7.

Figure 3:
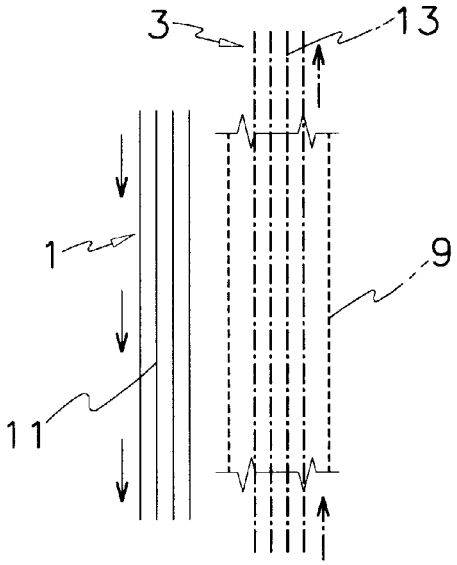
FIG. 3 is a detailed view of the B portion of FIG. 1 showing current directions of the input terminal according to the present invention.

Since the currents that are input into the upper input wires 11 of the upper input terminal 1 and into the lower input wires 13 of the lower input terminal 3, shown in FIG. 3, flow oppositely to each other through the insulation bodies 9, the magnetic fields generated through the upper input wires 11 and the lower input wires 13 are offset, and accordingly, the electromagnetic waves are also offset.

Figure 2:
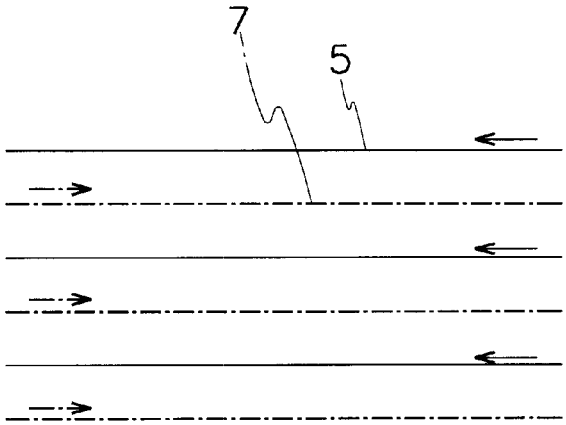
FIG. 2 is a detailed view of the A portion of FIG. 1 showing current directions of heat generation wires according to the present invention.

In addition, since the currents that are input into the first heat generation wires 5 and the second heat generation wires 7, as shown in FIG. 2, flow oppositely to each other, the magnetic fields generated by the currents flowing through the first heat generation wires 5 and the second heat generation wires 7 are offset, and thus the electromagnetic waves are also offset.

Figure 5:
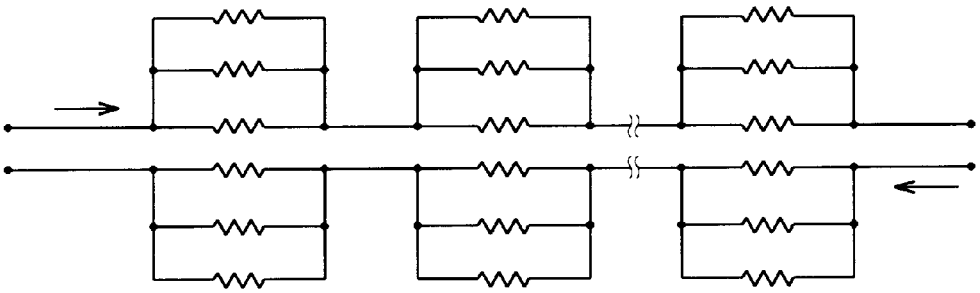
FIG. 5 is a schematic drawing representing an equivalent circuit wiring drawing of FIG. 1.

An equivalent circuit drawing for the currents that are flowing through the upper input terminal 1, the lower input terminal 3, the first heat generation wires 5, and the second heat generation wires 7 is shown in FIG. 5.

Figure 4:
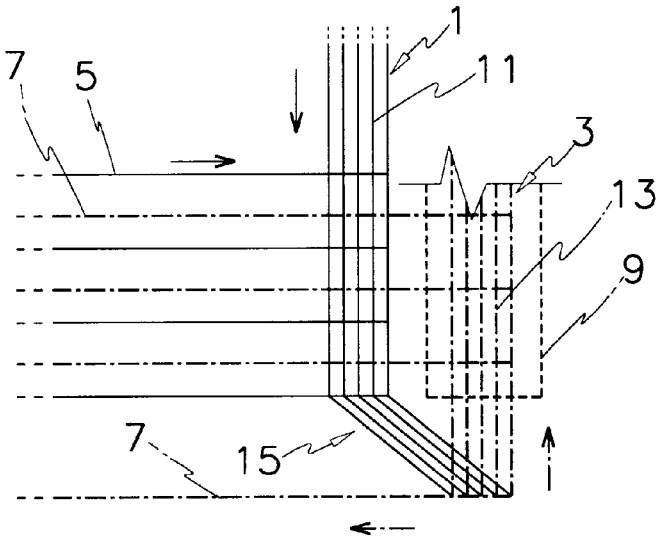
FIG. 4 is a detailed view of the C portion of FIG. 1 showing current directions at a junction of the input terminal according to the present invention.

The currents going through both the upper input terminal 1 and the lower input terminal 3 flow in the junction 15. As shown in FIG. 4, the currents through these terminals flow in opposite directions to each other from the central junction 15, and accordingly, the magnetic fields generated by the first heat generation wires 5 and the second heat generation wires 7 are offset with each other. Consequently, electromagnetic waves, which are damaging to the human body, are eliminated by preventing the formation of magnetic fields from the currents flowing through the heat generation wires and the input terminal.

The plane heating element of the present invention not only protects against the effects of EMF, but also can meet EMF regulations.

Although preferred embodiment of the present invention has been described in detail hereinabove, it should be clearly understood that many variations and/or modifications of the basic inventive concepts herein taught which may appear to those skilled in the present invention, as defined in the appended claims.

What is claimed is:

1. A plane heating element for eliminating electromagnetic waves comprising:

an upper input terminal and a lower input terminal spaced from each other at a predetermined interval and having oppositely directed current flows to each other;

first heat generation wires spatially disposed substantially on a first plane and connected to said upper input terminal at a predetermined interval and having the same directed current flow as that of the upper input terminal, second heat generation wires spatially disposed substantially on a second plane substantially parallel to the first plane and connected to said lower input terminal at a predetermined interval spaced from the first heat generation wires and having oppositely directed current flow to that of the first heat generation wires; and insulation bodies for separating the upper input terminal from the lower input terminal and thus insulating them.

2. A plane heating element for eliminating electromagnetic waves according to claim 1, wherein the upper input terminal includes upper input wires and the lower input terminal includes lower input wires, the upper input wires and the lower input wires being disposed at spaced intervals on an upper and a lower face of the insulation bodies and disposed oppositely to each other at a predetermined interval.

3. A plane heating element for eliminating electromagnetic waves comprising:

a pair of parallel insulation bodies disposed at a predetermined interval;

a pair of upper terminals disposed on an upper side of the pair of insulation bodies, each upper terminal having a length and two ends, and the pair of upper terminals being connected at one of the two ends;

a pair of lower terminals disposed on a lower side of the pair of insulation bodies, each lower terminal having a length and two ends, and the pair of lower terminals being connected at one of the two ends;

first heat generation wires, each having ends connected substantially perpendicular to the length of each upper terminal and spaced at a predetermined interval; and second heat generation wires, each having ends connected substantially perpendicular to the length of each lower terminal, each of the second heat generation wires being disposed substantially between a pair of adjacent first heat generation wires.

* * * * *